US007701324B2

(12) United States Patent
Lin

(10) Patent No.: US 7,701,324 B2
(45) Date of Patent: Apr. 20, 2010

(54) COLLABORATIVE WIRELESS MICRO-CONTROL SYSTEM

(75) Inventor: Wei-Cheng Lin, Taipei (TW)

(73) Assignee: Unified Packet Systems Corp., Taipet (TW)

( * ) Notice: Subject to any disclaimer, the term of this patent is extended or adjusted under 35 U.S.C. 154(b) by 224 days.

(21) Appl. No.: 12/000,117

(22) Filed: Dec. 10, 2007

(65) Prior Publication Data

US 2008/0150703 A1 Jun. 26, 2008

Related U.S. Application Data

(60) Provisional application No. 60/874,976, filed on Dec. 15, 2006.

(51) Int. Cl.
*G08B 9/00* (2006.01)

(52) U.S. Cl. ..... 340/286.02

(58) Field of Classification Search ..... 340/286.02, 340/3.1, 310.11, 538, 539.14, 825.69
See application file for complete search history.

(56) References Cited

U.S. PATENT DOCUMENTS 6,636,157 B1 * 10/2003 Sato ..... 340/825.22
6,653,933 B2 * 11/2003 Raschke et al. ..... 370/203
6,985,087 B2 * 1/2006 Soliman ..... 340/870.02
7,161,483 B2 * 1/2007 Chung ..... 340/531

* cited by examiner

*Primary Examiner*—Phung Nguyen
(74) *Attorney, Agent, or Firm*—Bacon & Thomas, PLLC

(57) ABSTRACT

A collaborative wireless micro-control system applied to a detached space comprises a main control unit, and a plurality of interior control unit. Wherein, the main control unit has a microprocessor, a transmitter, and a receiver. The receiver receives the outside wireless signal from the electronic apparatus. The microprocessor parses the outside wireless signal and sends out a wireless control signal inside the detached space by using the transmitter. Each of the interior control units has a microprocessor, a transmitter, and a receiver. The control unit is utilized as a user interface (human machine interface) for controlling a respective electronic apparatus. The receiver of the interior control unit receives the wireless control signal from the main control unit. The microprocessor of the interior control unit tells whether the wireless control signal can trigger the respective electronic apparatus or not. If so, the interior control unit adjusts the respective electronic apparatus according to the wireless control signal. If not, the transmitter of the interior control unit passes the wireless control signal to another interior control unit.

17 Claims, 12 Drawing Sheets

COLLABORATIVE WIRELESS MICRO-CONTROL SYSTEM

CROSS-REFERENCE TO RELATED APPLICATIONS

This Application claims the benefit of Provisional Application No. 60/874,976, filed Dec. 15, 2006.

BACKGROUND OF THE INVENTION (1) Field of the Invention

The invention relates to a collaborative wireless control system, and more particularly to the collaborative wireless control system applied to a detached space which is wireless controlled by electronic apparatuses outside the detached space.

(2) Description of the Prior Art

Commonly, remote controls for electronic devices, such as televisions, stereo systems, DVD players, remote switches for lights or power systems and so on, are used to issue commands from a distance. In fact, majority of modern devices assign all their functional controls to their remotes, while the devices themselves only have primary controls. Most of these remotes communicate with their respective mother devices via infrared (IR) signals and a few thereof via radio signals.

However, during practical operation, users must aim remote controls at the electronic equipments due to the limitation of the signal transmission in receiving and launching the infrared signals. Such a limitation disables the remote control as long as the remote control disposes outside the IR signal transmission region.

In recent years, the advancement in computer technology brings the computer into human daily activities as an essential part of modern life. The appearance of the embedded system, information appliances, and home control network has brought various kinds of computer applications into human life. The interaction between human and the computer exists not only in the tiny space in front of the computer, but also exists in almost every environment, especially the so-called intelligent environment.

The intelligent environment is a highly context-aware interface. It is a space equipped with many sensors to monitor the activities in the environment. After gathering the information from the environment, the system will make appropriate reactions for some of the events. The intelligent environment can be seen as an artificial organism connecting a variety of appliances to surround the user, and can provide intelligent assistance and services for the user inside it. The goal is to provide a quality life through a multi-sensing multimodal intelligent environment.

The user can control the air condition, the light system, or even a gas system in a smart house through a mobile phone or a major remote control. For instance, the user chooses the normal mode to send the command, or he/she may choose a predetermined mode by using the mobile phone or a remote control to distantly turn on/off the electronic devices, or to adjust the room temperature and moisture setting of an air conditioner.

While in decorating a house, the wiring for parallel integrating all functions of video equipments, home cinema, security system, lighting control, visual communication, etc., should be hided for a vision purpose.

However, if the user wants to further assemble the intelligent control system, it is almost impossible to hide the wiring without damaging the decoration. The user must remove part of the decoration so as to arrange the wiring along the corner of the wall, from which possible damage to disturb the integrality of the decoration may bother the user. Definitely, such an wiring is usually expensive and may even generate a cost higher than an ordinary electric device Accordingly, since the traditional intelligent control system is too expensive and hard to maintain, a collaborative wireless micro-control system is provided in the present invention to use the signal transmitting circuit equipped in the control unit of the electric devices to transmit wireless signals so as to facilitate the user to remotely control the electric devices.

SUMMARY OF THE INVENTION

It is an object of the present invention to provide a collaborative wireless micro-control system by using the signal transmitting circuit equipped in the control unit of the electric devices to transmit wireless signals so as to facilitate the user to remotely control the electric devices.

A collaborative wireless micro-control system, applied to a detached space and capable of receiving an outside wireless signal from an electronic apparatus outside of the detached space, comprises a main control unit, and a plurality of interior control units. The main control unit has a microprocessor, a transmitter, and a receiver. The receiver receives the outside wireless signal from the electronic apparatus. The microprocessor parses the outside wireless signal and uses the transmitter to send out a wireless control signal.

Each of the interior control units has a microprocessor, a transmitter, and a receiver. The control unit is utilized as a user interface (human machine interface) for controlling a respective electronic apparatus.

The receiver of the interior control unit receives the wireless control signal from the main control unit. The microprocessor of the interior control unit tells whether the wireless control signal can trigger the respective electronic apparatus or not. If so, the interior control unit adjusts the respective electronic apparatus according to the wireless control signals. If not, the transmitter of the interior control unit passes the wireless control signal to another interior control unit.

According to the collaborative wireless micro-control system mentioned above, an operation method of a collaborative wireless micro-control system applied to a detached space is also provided in the present invention. The operation method comprises the steps of: (a) providing a plurality of electronic apparatuses in the detached space; (b) providing a plurality of interior control units for controlling the respective electronic apparatuses; (c) providing a wireless signal outside the detached space for controlling the target electronic apparatus; (d) providing a main control unit receiving the wireless signal, parsing the wireless signal and sending a wireless control signal into the detached space; (e) receiving the wireless control signal; (f) parsing the wireless control signal to tell whether the electronic apparatus with respect to the interior control unit receiving the wireless control signal is the target electronic apparatus or not; and (g) if so, controlling the respective electronic apparatus to perform movements according to the wireless control signal; and if not, sending the wireless control signal back into the detached space.

According to the collaborative wireless micro-control system mentioned above, a setting method of a collaborative wireless micro-control system applied to a detached space is also provided in the present invention. The setting method comprises the steps of: (a) providing a collaborative wireless micro-control system having at least a main control unit and an interior control unit; (b) installing and starting another interior control unit; (c) entering a setting selection process of the installed interior control unit; (d) choosing an auto-setting selection of the setting selection process of the installed interior control unit; (e) the installed interior control unit listening to a response from the collaborative wireless micro-control system; (f) the collaborative wireless micro-control system sending out a connecting invitation to the installed interior control unit; (g) the installed interior control unit accepting the connecting invitation; (h) the installed interior control unit replying an echo to the collaborative wireless micro-control system; (i) the installed interior control unit and the collaborative wireless micro-control system saving an identification of each other; and (j) the interior control unit broadcasting a newly entry signal to the collaborative wireless micro-control system.

BRIEF DESCRIPTION OF THE DRAWINGS

The features, objects, and advantages of the present invention will become more apparent from the following detailed description of the preferred embodiment of this invention, with reference to the accompanying drawings, in which:

FIGS. 4-1 and 4-2 shows a preferred embodiment of a setting method of the collaborative wireless micro-control system in the present invention;

FIGS. 5-1 and 5-2 shows a preferred embodiment of an operation method of the collaborative wireless micro-control system with a plurality of remote controls; and FIGS. 6-1 and 6-2 shows a preferred embodiment of an operation method of the collaborative wireless micro-control system with a sensor automatically receiving data.

DESCRIPTION OF THE PREFERRED EMBODIMENT

In order to facilitate user to control an interior electronic apparatus, the present invention applies the concept that the nodes of the wireless network are capable of communicating with each other to provide a collaborative wireless micro-control system. The collaborative wireless micro-control system in the present invention treats the control units of the electronic apparatus as nodes. By using the transmitter and receiver within the control unit to transmitting wireless control signals, the electronic apparatus anywhere in the detached space can be controlled.

Figure 1:
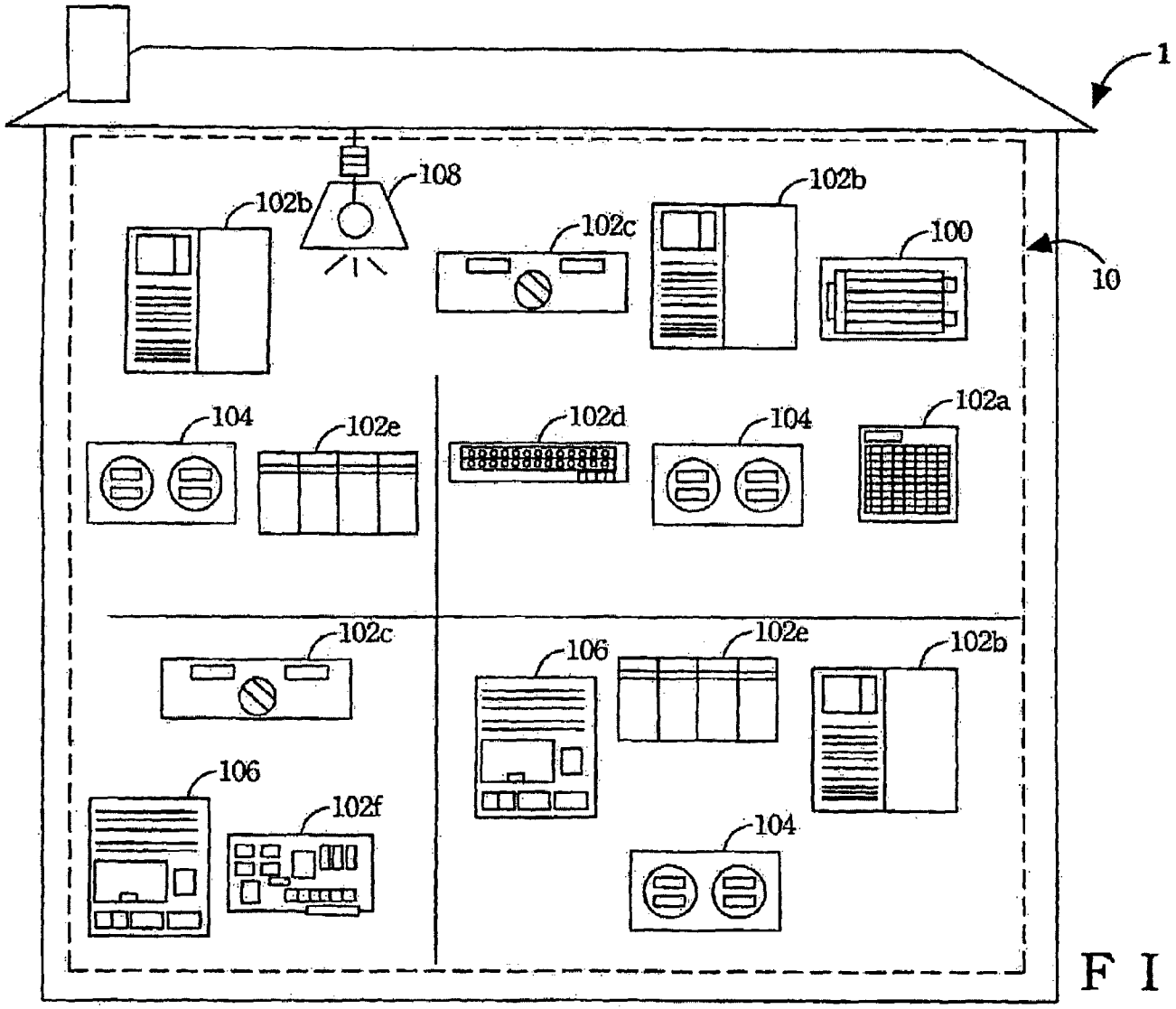
FIG. 1 is a schematic view showing an application of a collaborative wireless micro-control system in the present invention.

FIG. 1 is a schematic view showing an application of a collaborative wireless micro-control system in the present invention. The collaborative wireless micro-control system 10 is applied in a detached space 1. The detached space 1 may be an interior of a house, an office or any other architecture. The collaborative wireless micro-control system 10 comprises a main control unit 100, a plurality of interior control units 102, a plurality of remote controls (not shown in this figure), a plurality of outlets 104, and a plurality of sensors 106.

The main control unit 100 has a microprocessor, a transmitter, and a receiver. The main control unit 100 may further have a touch panel. In addition, the main control unit 100 may be controlled by using the remote control. The main control unit 100 is utilized as a gateway of the collaborative wireless micro-control system 10 for transmitting or receiving outside wireless signals.

The user may send commands to the main control unit 100 by using the remote control or the touch panel. In addition, the main control unit 100 may receive outside wireless signals generated by an electronic apparatus outside the detached space 1. Then, the microprocessor of the main control unit 100 parses the outside wireless signal and broadcasts a wireless control signal inside the detached space 1 by using the transmitter to start the operation. The main control unit 100 may further respond the result of the operation back to the electronic apparatus outside the detached space 1.

The plurality of interior control units 102 is utilized for control a plurality of respective electronic apparatuses 108. An interior control unit 102 may be utilized for controlling a respective electronic apparatus 108, plural interior control units 102 may be utilized for controlling a respective electronic apparatus 108, or an interior control unit 102 is utilized for controlling a plurality of electronic apparatuses 108. For example, the lamp switch 102*e* may be utilized for controlling on/off of the lamp, the intercoms 102*b* may be utilized for controlling the opening of the door, and the multi-function interior control unit 102*d* may be utilized to control the whole video system.

As mentioned, the interior control units 102, such as the wireless switch 102*a*, the intercom 102*b*, the rotational switch 102*c*, the multi-function control unit 102*d*, the Single-Pole-Single-Throw (SPST) switch 102*e*, the data gathering control unit 102*f*, etc., are utilized as user interfaces (human machine interface) for sending commands to control respective electronic apparatuses 108, such as audio system, television, sensor, air conditioner, lamp, and etc.

The remote controls are utilized for controlling the respective electronic apparatuses through the respective control units. Not every control unit 102 needs a remote control. Generally, each of the remote controls has a battery, a microprocessor, a transmitter, and a receiver. In addition, the remote control may further have a bulb and a display.

Each outlet 104 has a microprocessor, a transmitter, and a receiver to facilitate wireless communication. The microprocessor, the transmitter, and the receiver may be plugged in the outlet 104 or equipped on the hidden surface of the outlet 104.

Each sensor 106 has a display, a microprocessor, a sensing device, a selector, a transmitter, and a receiver. The sensing device is utilized to transmit the received analog signals to the microprocessor. The display is utilized for showing the data detected by the sensing device. There may be various sensors for detecting different data, such as air pressure, temperature, the concentration of specific gas in the air, brightness, etc.

The microprocessor of the sensor 106 parses the data detected and transmits a signal by using the transmitter to the respective interior control unit 102 as a control signal to drive the interior control unit 102. For example, as the room temperature is higher than a preset temperature, the sensor 106 sends a signal to the interior control unit 102 of the air conditioner to introduce more-cold-wind flow; as the concentration of CO2 is greater than a preset level, the sensor sends a signal to the interior control unit 102 of an alarming system for further informing the user, or for directly starting an air circulation equipment.

The main control unit 100 of the collaborative wireless micro-control system 10 receives and parses the outside wireless signals, then broadcasts a wireless control signal in the detached space. All the neighboring interior control units 102, remote controls, outlets 104, or sensors 106 located within the transmission range of the main control unit 100 may receive the wireless control signal. Then, the microprocessor of interior control unit 102, the remote control, the outlet 104, or the sensor 106 may tell whether the wireless control signal can trigger the respective electronic apparatus or not. If so, the respective electronic apparatus is adjusted according to the wireless control signal. If not, the wireless control signal is passed by to another interior control unit, until the correct electronic apparatus is met. In addition, as the correct electronic apparatus is met and functioned, the main control unit 100 may respond a signal to the user to announce the user that the specific electronic apparatus is correctly functioned.

FIGS. 2A-2G show various embodiments of the collaborative wireless micro-control system 10 in accordance with the present invention. These embodiments may be applied to the main control unit, the interior control unit, the sensor, the outlet, or even the electronic apparatus. However, for a better understanding, the interior control unit is depicted by an example.

Figure 2A:
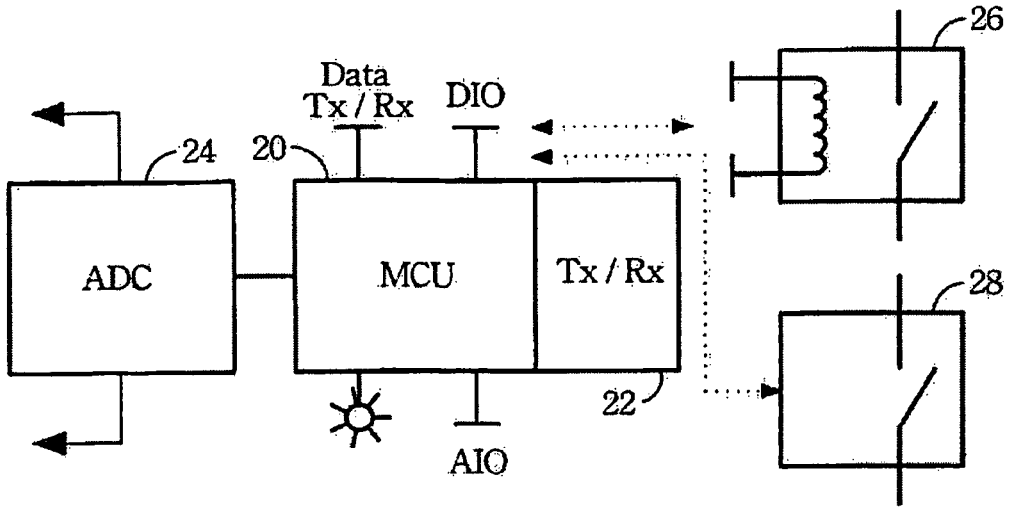
FIG. 2A is a schematic view of the interior control unit of a first preferred embodiment of the collaborative wireless micro-control system in the present invention.

FIG. 2A is a schematic view of a first embodiment of the interior control unit of the collaborative wireless micro-control system 10 in the present invention. The interior control unit has at least a microprocessor 20, a transmitter/receiver 22, a digital to analog (DA) converter 24, a relay 26, and a switch 28. The microprocessor 20 is electrically connected to the transmitter/receiver 22 at one end and, at another end, to the DA converter 24 for controlling the transmitting of the wireless signal and for controlling the current applied to the electronic apparatus. In addition, the microprocessor 20 has a plurality of inputs and outputs (IO) and a bulb. The IOs include the data IO*, the digital signal IO (DIO), and the analog signal IO (AIO). The microprocessor transmits data through these IOs to the wiring.

The relay 26 to go with the operation of the switch 28 is utilized for breaking up or reconnecting the power supply to the circuit so as to turn on or turn off the interior control unit. The signals communicated between the relay 26, the microprocessor 20, and the switch 28 may be transmitted through the DIO. The switch 28 may be a typical SPST switch, a button-activated switch, or a switch on a touch panel.

Figure 2B:
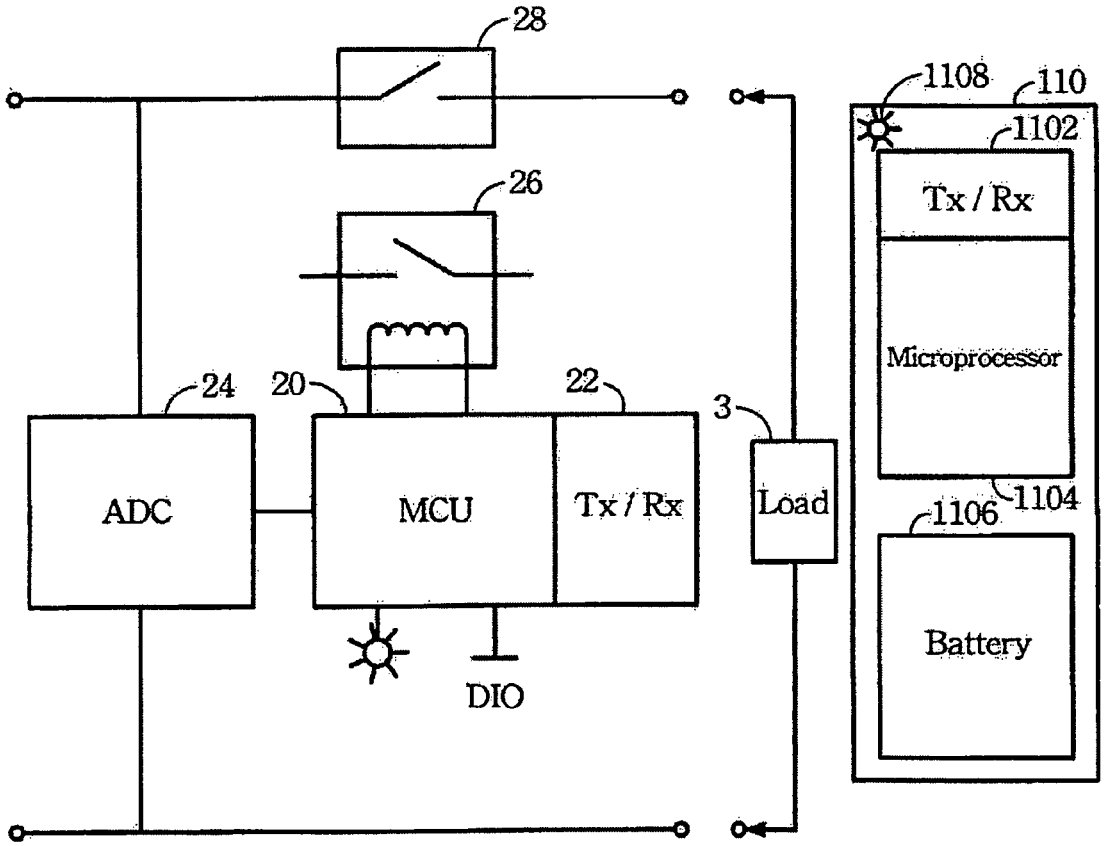
FIG. 2B is a schematic view of the interior control unit and a remote control of a second embodiment of the collaborative wireless micro-control system in the present invention.

FIG. 2B is a schematic view of a second embodiment of the interior control unit and a remote control of the collaborative wireless micro-control system 10 in the present invention. In contrast with the interior control unit of FIG. 2A, the relay 26 and the switch 28 of the present embodiment are connected to the microprocessor 20 in parallel, and the interior control unit connects the electronic apparatus 3 as a load thereof through wiring. The remote control 110 has a microprocessor 1104, a transmitter/receiver 1102, a battery 1106, and a bulb 1108.

It is noted that the electronic apparatus 3 may be turned on or turned off by using either the switch 28 of the interior control unit or the remote control 110.

Figure 2C:
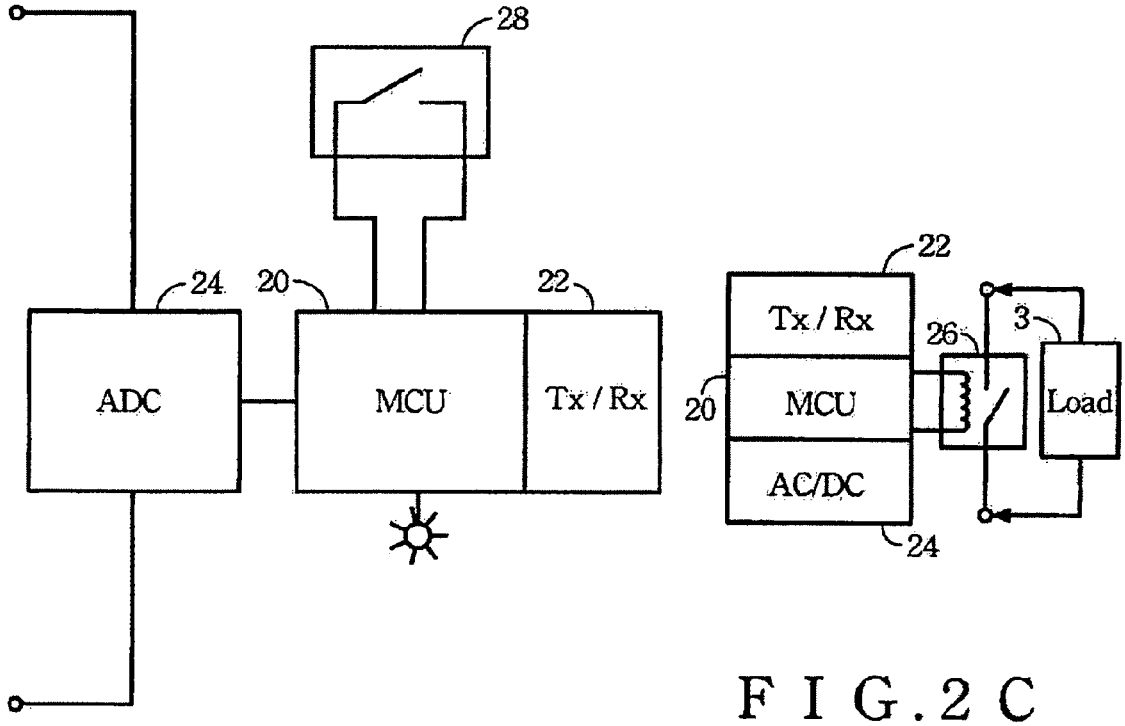
FIG. 2C is a schematic view of an interior control unit and the load of a third embodiment of the collaborative wireless micro-control system in the present invention.

FIG. 2C is a schematic view of a third embodiment of the interior control unit and the load of the collaborative wireless micro-control system in the present invention. In contrast with the interior control unit of FIG. 2B, the interior control unit of the present embodiment skips the relay but uses the switch 28 for switching control directly. The electronic apparatus (or the load) is connected to a microprocessor 20, a transmitter/receiver 22, a DA converter 24, and a relay 26.

It is noted from FIG. 2A to FIG. 2C that there is no wiring between the interior control unit and the electronic apparatus 3. The interior control unit transmits wireless signals to the transmitter/receiver 22 connected to the electronic apparatus 3. The microprocessor 20 parses the wireless signal to decide the operation of the electronic apparatus 3.

Figure 2D:
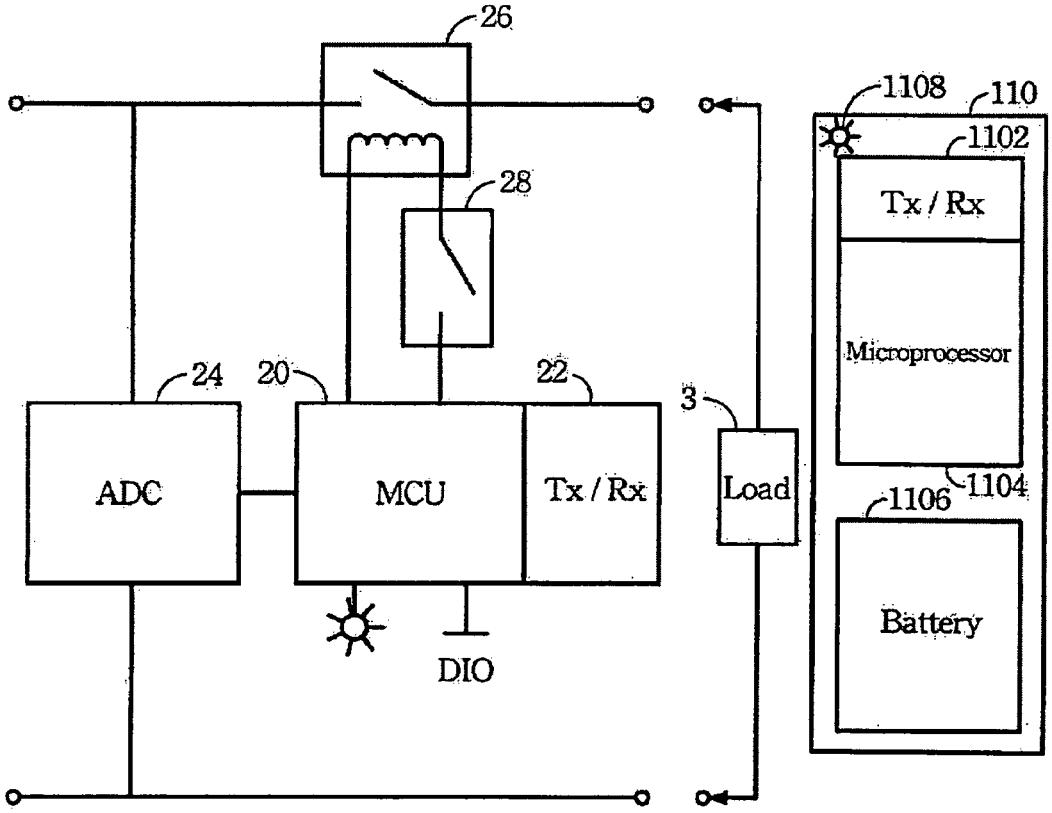
FIG. 2D is a schematic view of a fourth embodiment of the collaborative wireless micro-control system in the present invention.

FIG. 2D is a schematic view of a fourth embodiment of the collaborative wireless micro-control system in the present invention. In contrast with the interior control unit of FIG. 2B, the relay 26 and the switch 28 of the interior control unit are connected to the microprocessor 20 in a serial for switching control. The electronic apparatus 3 may be turned on or off through the switch 28 of the interior control unit or the remote control 110. But only when the switch 28 of the interior control unit is turned on, the command from the remote control 110 can be executed.

Figure 2E:
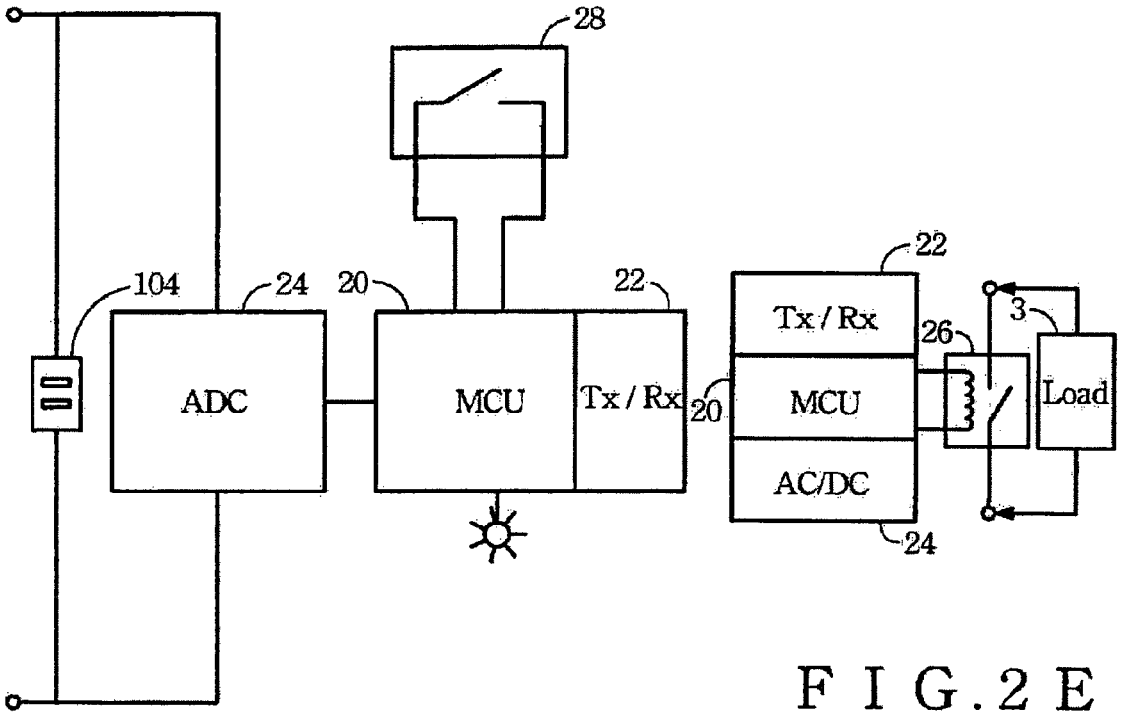
FIG. 2E is a schematic view of a fifth embodiment of the collaborative wireless micro-control system in the present invention.

FIG. 2E is a schematic view of a fifth embodiment of the collaborative wireless micro-control system in the present invention. In contrast with the embodiment of FIG. 2C, the interior control unit of the present embodiment is connected to an outlet 104 by wiring.

Figure 2F:
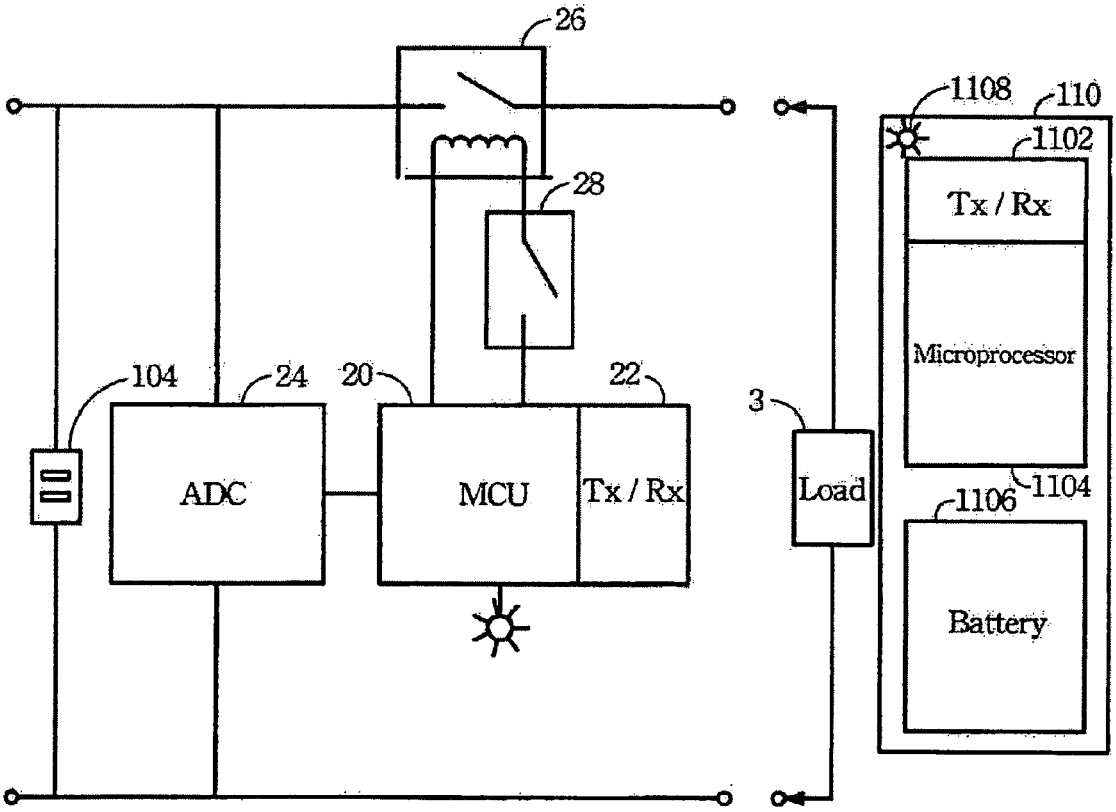
FIG. 2F is a schematic view of a sixth embodiment of the collaborative wireless micro-control system in the present invention.

FIG. 2F is a schematic view of a sixth embodiment of the collaborative wireless micro-control system in the present invention. In contrast with the embodiment of FIG. 2D, the interior control unit of the present embodiment is connected to an outlet 104 by wiring.

Figure 2G:
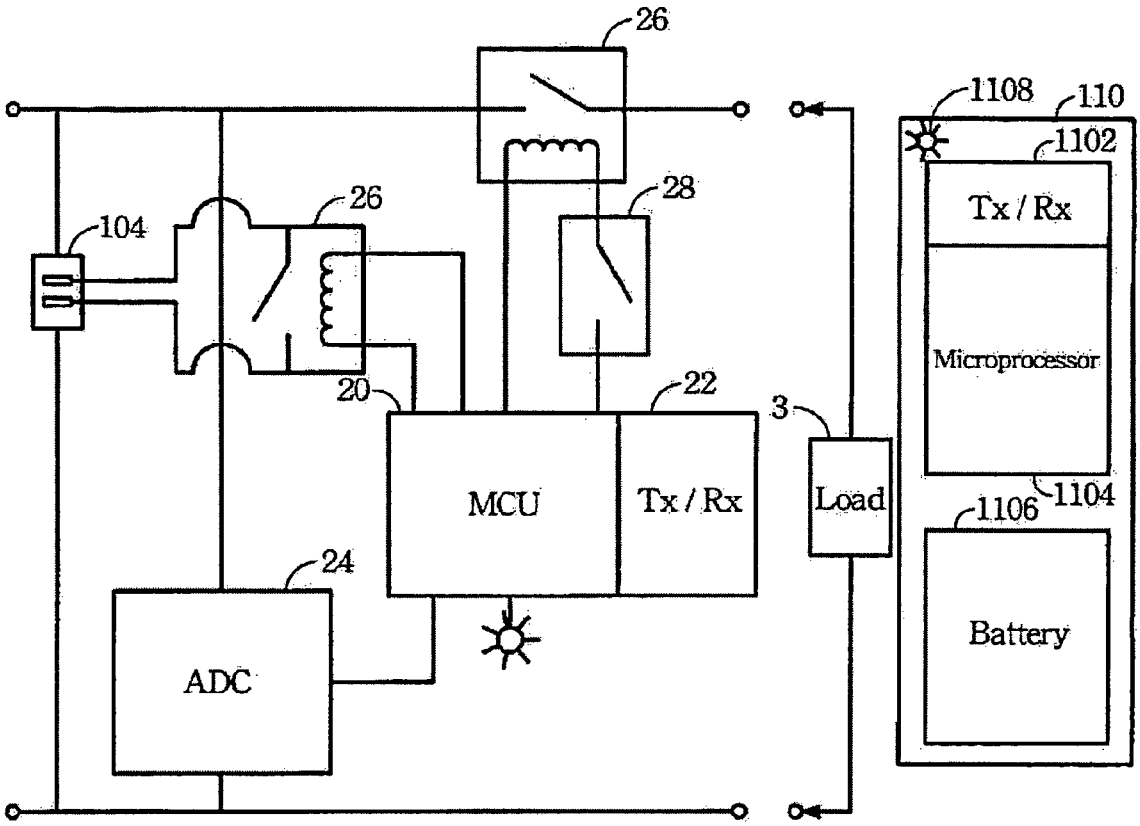
FIG. 2G is a schematic view of a seventh embodiment of the collaborative wireless micro-control system in the present invention.

FIG. 2G is a schematic view of a seventh embodiment of the collaborative wireless micro-control system in the present invention. In contrast with the embodiment of FIG. 2F, the outlet 104 of the present embodiment is connected to the microprocessor 20 of the interior control unit through a relay 26. Thereby, the outlet 104 may control the operation of the electronic apparatus 3.

It is noted that the above-mentioned embodiments are only some of various examples of the present invention. The present invention should not be restricted by the above-mentioned embodiments.

Figure 3:
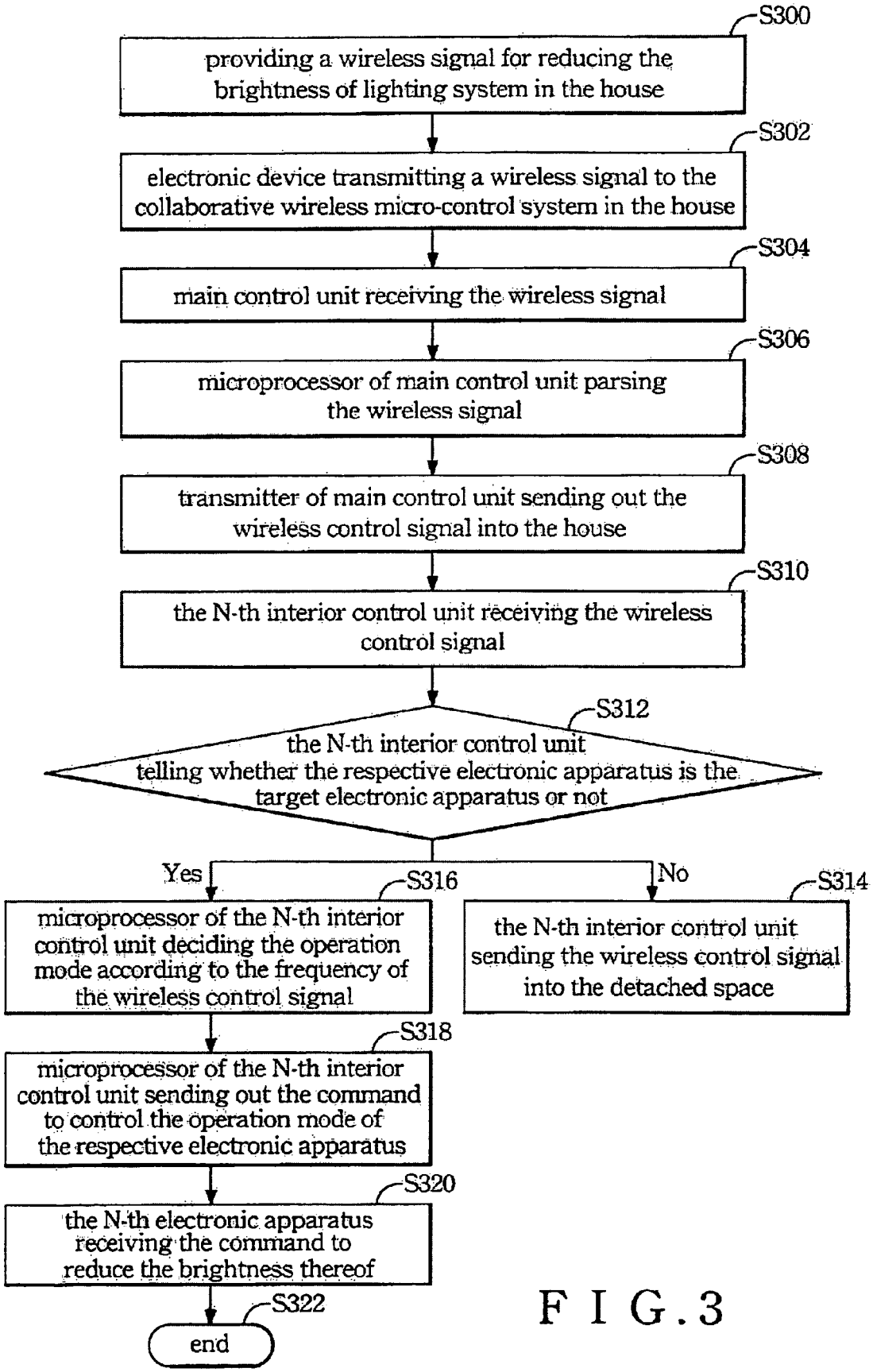
FIG. 3 shows a preferred embodiment of an operation method of the collaborative wireless micro-control system in the present invention.

FIG. 3 shows a preferred embodiment of an operation method of the collaborative wireless micro-control system receiving an outside wireless signal to control a target electronic apparatus among various electronic apparatuses in the detached space. Detail descriptions of the present embodiment are mentioned below.

Firstly, in step S300, the user uses a portable electronic device, such as a cell phone, a personal digital assistant, a notebook, etc., to provide a wireless signal outside the house (the detached space) for reducing the brightness of lighting system (the target electronic apparatus) in the house. Then, in step S302, the electronic device transmits a wireless signal through a wireless station to the gateway of the collaborative wireless micro-control system in the house. Afterward, in step S304, the main control unit receives the wireless signal. It is noted that the main control unit of the collaborative wireless micro-control system in the present is the gateway for transmitting and receiving signals.

Thereafter, in step S306, the microprocessor of the main control unit parses the wireless signal and sends out a wireless control signal to the transmitter of the main control unit. Then, in step S308, the transmitter sends out the wireless control signal into the house. All the interior control units within the transmission range of the transmitter of the main control unit may receive the wireless control signal.

Then, in step S310, the interior control unit (the Nth interior control unit, for example) within the transmission range receives the wireless control signal. Afterward, in step S312, the interior control unit parses the wireless control signal to tell whether the respective electronic apparatus is the target electronic apparatus or not.

If not, in step S314, the interior control unit sends the wireless control signal back into the detached space. It is noted that all the interior control units within the transmission range of the transmitter of the present interior control unit may receive the wireless control signal. Thereby, the overall transmission range of the wireless control signal can be enhanced.

If so, in step S316, the microprocessor of the interior control unit decides the operation mode according to the frequency of the wireless control signal. Then, in step S318, the microprocessor of the interior control unit sends out the command to control the operation mode of the respective electronic apparatus (the lighting system). Afterward, in step S320, the electronic apparatus receives the command from the interior control unit to reduce the brightness thereof. Then, in step S322, the operation is ended.

Figures 1, 4:
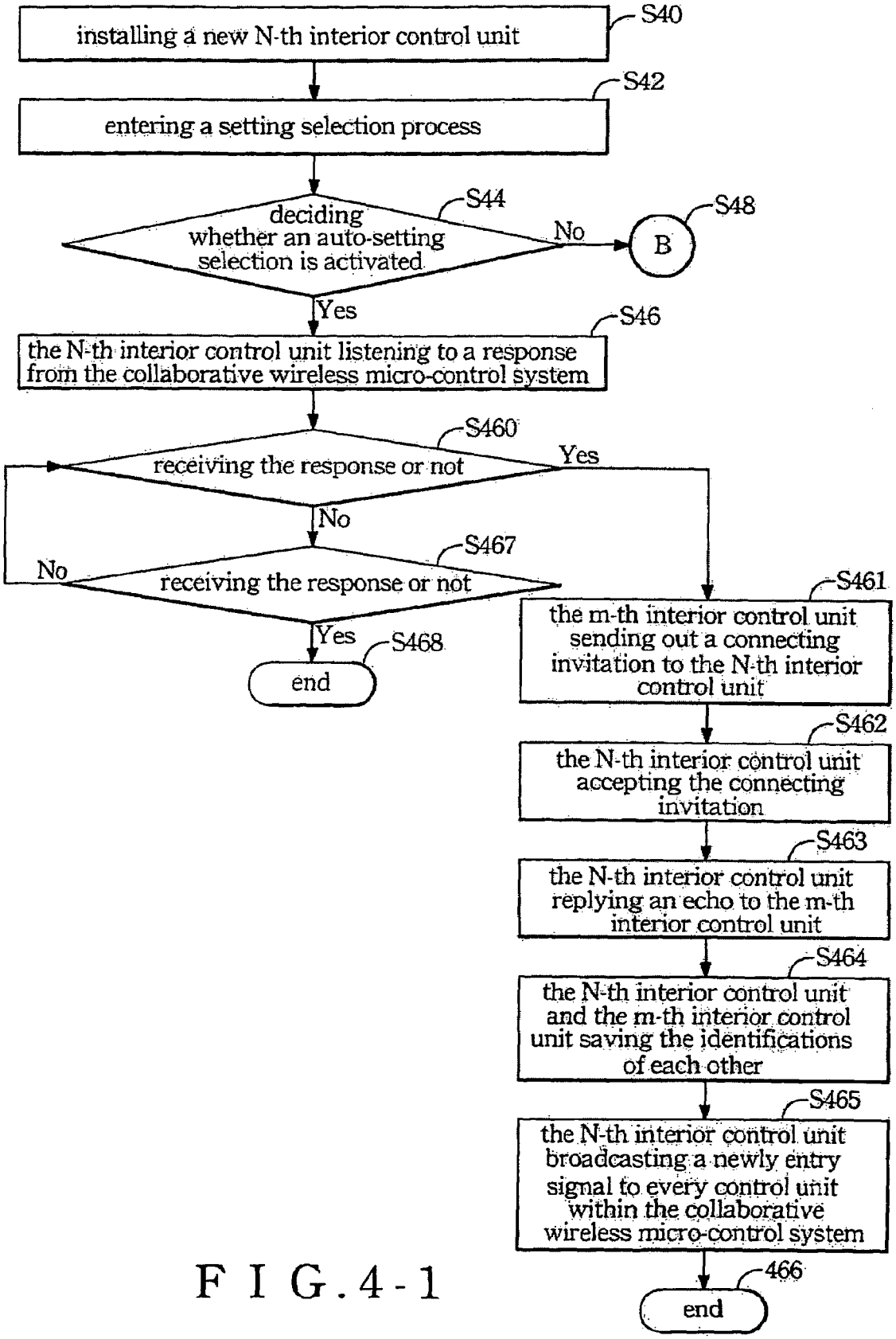
Figures 2, 4:
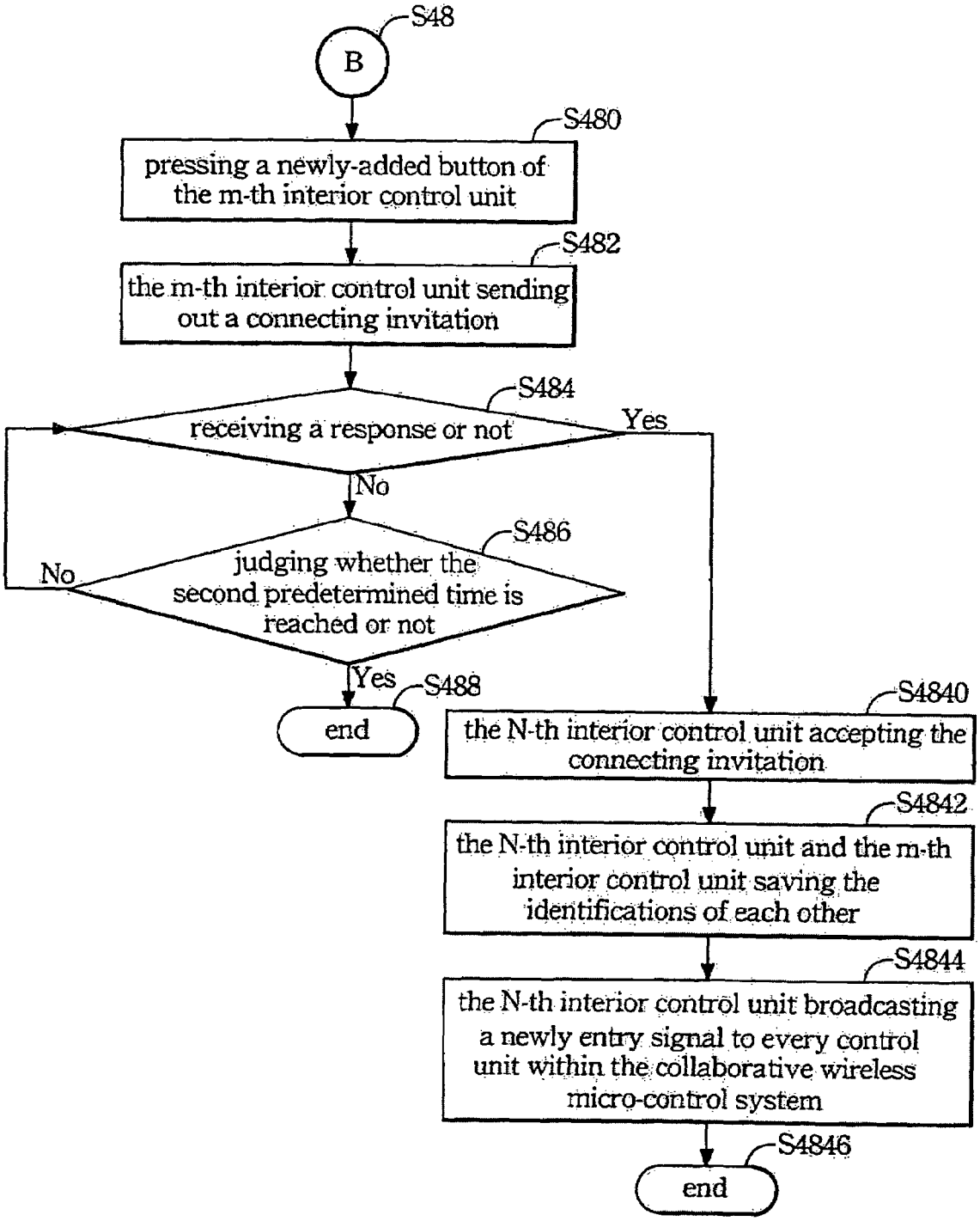

FIGS. 4-1 and 4-2 shows a preferred embodiment of a setting method of a collaborative wireless micro-control system in the present invention. It is noted that, to meet a newly added electronic apparatus in the detached space, a respected interior control unit, a sensor, and a remote control need to be added to the collaborative wireless micro-control system, which has already at least a main control unit and an interior control unit. The following embodiment shows the situation that an interior control unit is newly added to the collaborative wireless micro-control system.

Firstly, in step S40, a new electronic apparatus (the N-th electronic apparatus) is added into the detached space. To install and start the interior control unit (the N-th interior control unit), the power supply of the electronic apparatus is turned on. Then, in step S42, enter a setting selection process of the installed interior control unit. Afterward, in step S44, decide whether an auto-setting selection is activated.

If the auto setting selection of the setting selection process of the installed interior control unit is chosen, in step S46, the installed interior control unit listens to a response from the collaborative wireless micro-control system. Then, in step S460, the installed interior control unit waits for a first predetermined time.

If the installed interior control unit does not receive the response from the collaborative wireless micro-control system, in step 467, the installed interior control unit may judge whether the predetermined time is reached or not. If not, go back to step S460. If so, in step S468, finish the auto-setting selection of the setting selection process of the installed interior control unit.

If the installed interior control unit receives the response, in step S461, an already-set interior control unit (the m-th interior control unit) in the collaborative wireless micro-control system sends out a connecting invitation to the installed interior control unit. It is noted that the already-set interior control unit may be anyone within the collaborative wireless micro-control system that has a transmission range covering the installed interior control unit. Then, in step S462, the installed interior control unit accepts the connecting invitation. Afterward, in step S463, the installed interior control unit replies an echo to the already-set interior control unit in the collaborative wireless micro-control system. Thereafter, in step S464, the installed interior control unit and the already-set interior control unit save the identifications of each other. Then, in step S465, the installed interior control unit broadcasts a newly entry signal to every control unit within the collaborative wireless micro-control system. Then, in step S466*, after all the control units of the collaborative wireless micro-control system receive the broadcasting signal, the auto-setting process is finished.

If the auto setting selection of the setting selection process of the installed interior control unit is not chosen, then, in step S48, a manual setting process B is started. Referring to FIG. 4-2, in step S480, the user presses a newly-added button of an already-set interior control unit in the collaborative wireless micro-control system. Afterward, in step S482, the already-set interior control unit sends out a connecting invitation to the installed interior control unit. It is noted that the already-set interior control unit may be anyone within the collaborative wireless micro-control system that has a transmission range covering the installed interior control unit.

Then, in step S484, the already-set interior control unit waits for a second predetermined time. If the already-set interior control unit does not receive a response of the connecting invitation, in step S486, the already-set interior control unit may judge whether the predetermined time is reached or not. If not, go back to step S484. If so, in step S488, finish the manual-setting process.

If the already-set interior control unit receives the response, in step S4840, the user presses the newly-add button of the installed interior control unit and accepts the connecting invitation. Then, in step S4842, the installed interior control unit and the already-set interior control unit save the identifications of each other. Then, in step S4844, the installed interior control unit broadcasts a newly entry signal to every control unit within the collaborative wireless micro-control system. Then in step S4846, after all the control units of the collaborative wireless micro-control system receive the broadcasting signal, the manual-setting process is finished.

Figures 1, 5:
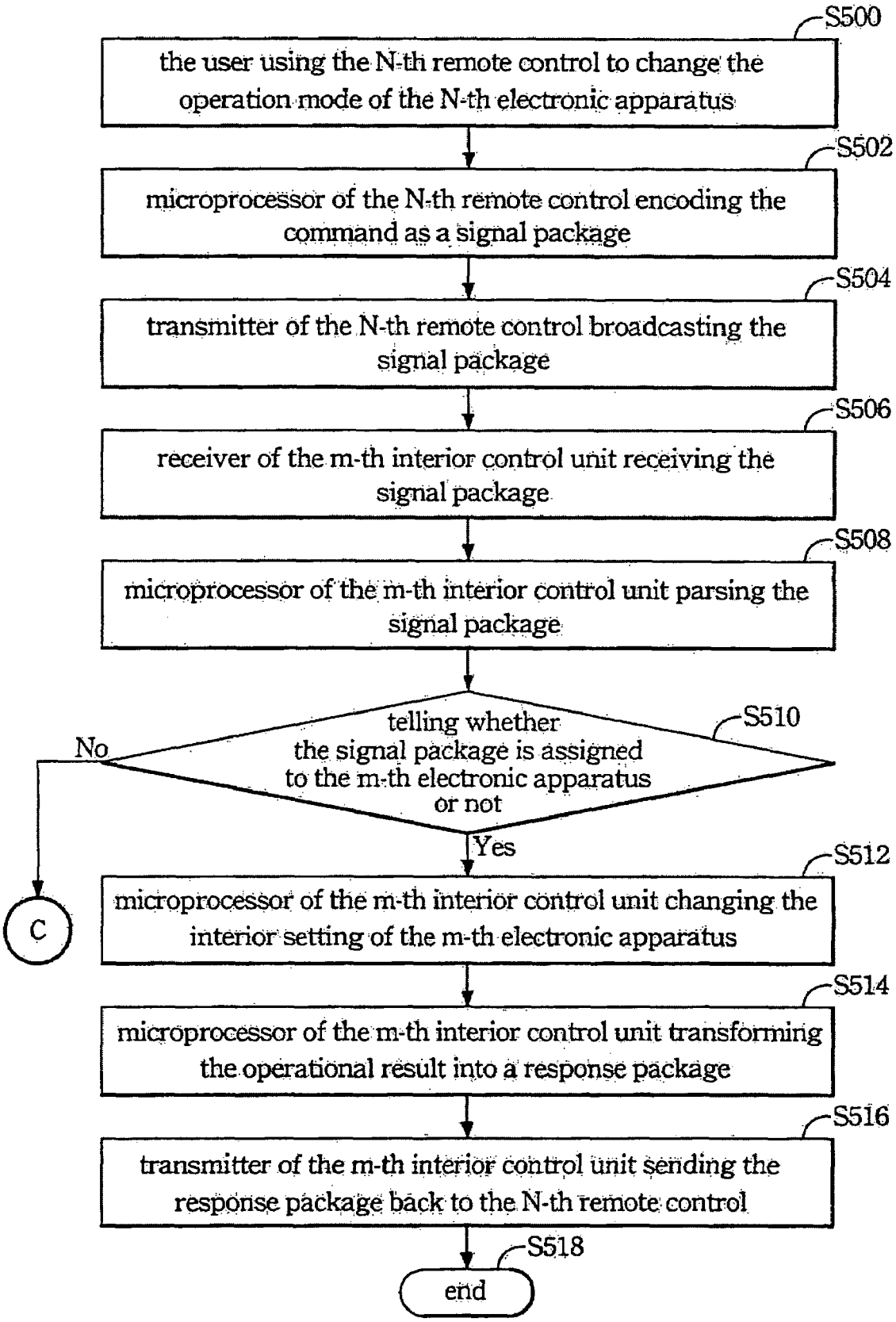
Figures 2, 5:
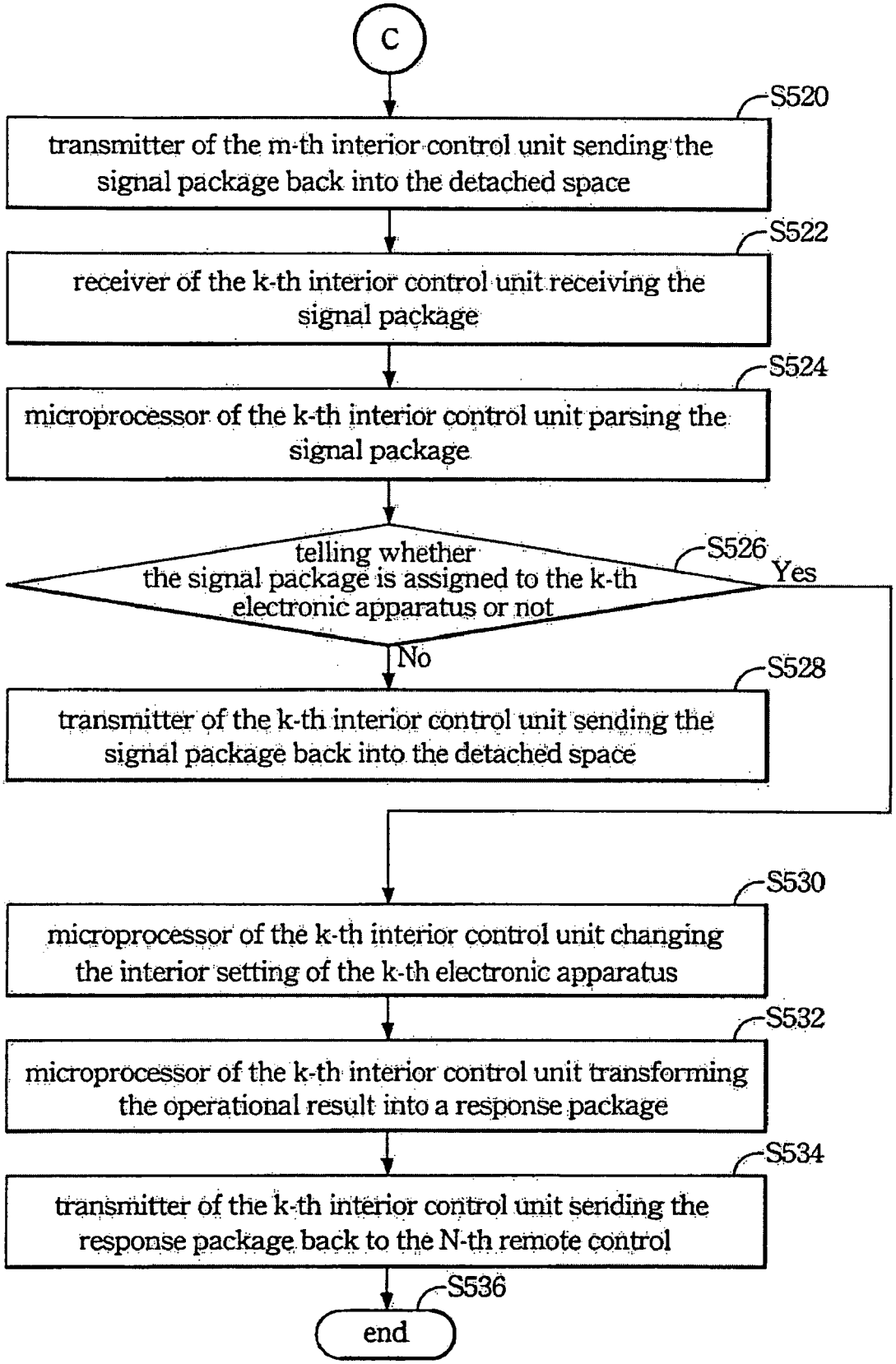

FIGS. 5-1 and 5-2 shows a preferred embodiment of an operation method of the collaborative wireless micro-control system with a plurality of remote controls, respective interior control units and electronic apparatuses. The collaborative wireless micro-control system is capable of having the remote control to control the respective interior control unit and the respective electronic apparatus anywhere inside the detached space. Detail descriptions of the present embodiment are provided below.

Firstly, in step S500, the user uses the remote control (the N-th remote control) to change the operation mode of the respective electronic apparatus (the N-th electronic apparatus). Then, in step S502, the microprocessor of the remote control encoded the command as a signal package. Then, in step S504, the transmitter of the remote control broadcasts the signal package in the detached space. All the control units within the transmission range of the transmitter of the remote control may receive the signal package. Afterward, in step S506, the receiver of the interior control unit (the m-th interior control unit) within the transmission range receives the signal package. Afterward, in steps S508 and S510, the microprocessor of the interior control unit parses the signal package and tells whether the signal package is assigned to the respective electronic apparatus of the interior control unit.

If so, in step S512, the microprocessor of the interior control unit changes the interior setting of the electronic apparatus to vary the operation mode according to the signal package. That is, the m-th electronic apparatus is the Nt-h electronic apparatus. Then, in step S514, the microprocessor of the interior control unit transforms the operational result into a response package by using the DA converter. Afterward, in step S516, the transmitter of the interior control unit sends the response package back to the remote control. Then, in step S518, the operation process is ended.

If not, process C is started. Referring to FIG. 5-2, in step S520, the transmitter of the interior control unit sends the signal package back into the detached space. It is noted that all the interior control units within the transmission range of the transmitter of the present interior control unit may receive the signal package. Thereby, the overall transmission range of the signal package is enhanced. Then, in step S522, the receiver of another interior control unit (the k-th interior control unit) within the transmission range receives the signal package. Afterward, in steps S524 and S526, the microprocessor of the interior control unit parses the signal package and tells whether the signal package is assigned to the respective electronic apparatus of the interior control unit.

If not, in step S528, the transmitter of the interior control unit also sends the signal package back into the detached space so as to enhance the overall transmission range of the signal package.

If so, in step S530, the microprocessor of the interior control unit changes the interior setting of the electronic apparatus to vary the operation mode according to the signal package. That is, the k-th electronic apparatus is the N-th electronic apparatus. Then, in step S532, the microprocessor of the interior control unit transforms the operational result into a response package by using the DA converter. Afterward, in step S534, the transmitter of the interior control unit sends the response package back to the remote control. Then, in step S536, the operation process is ended.

Figures 1, 6:
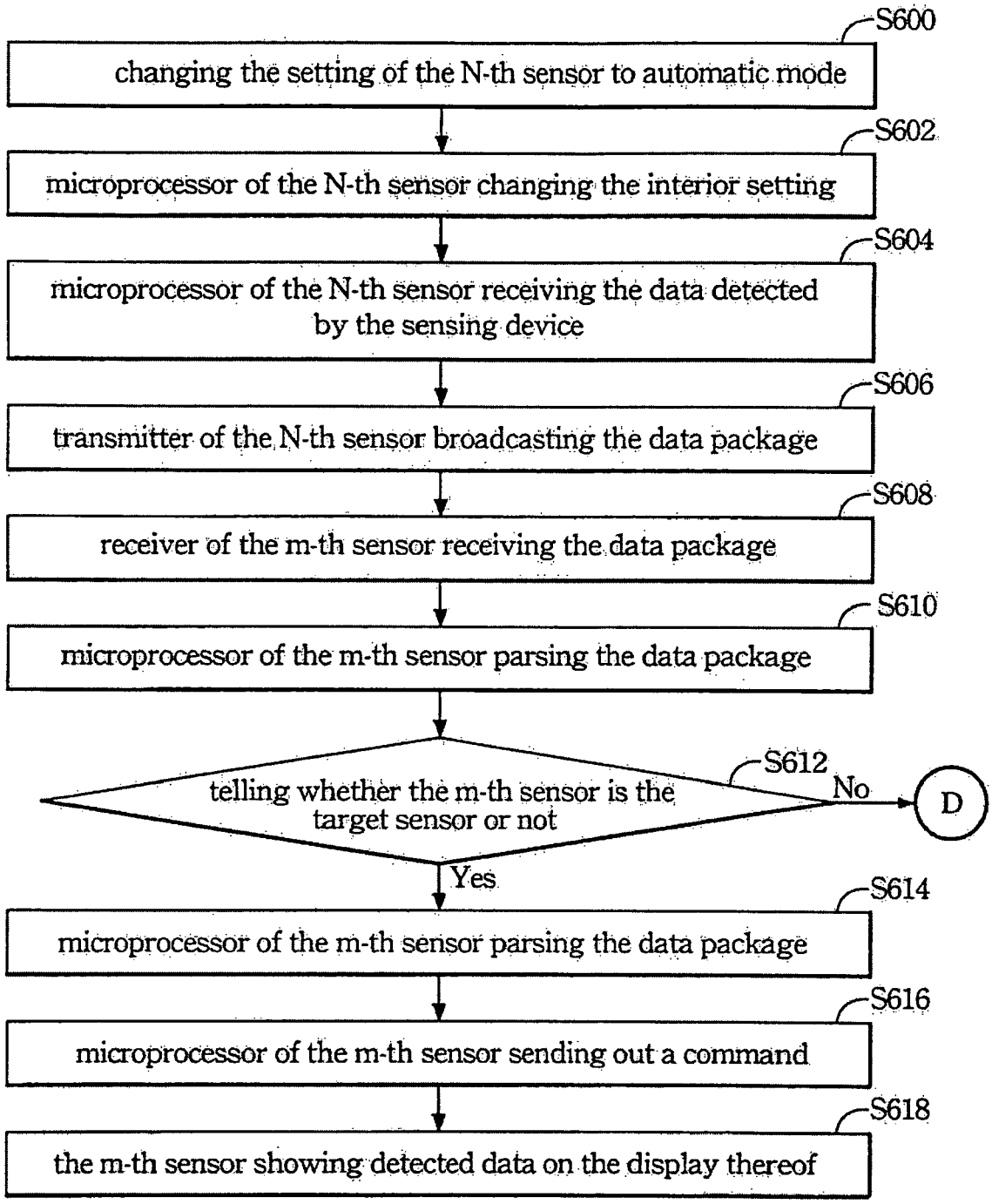
Figures 2, 6:
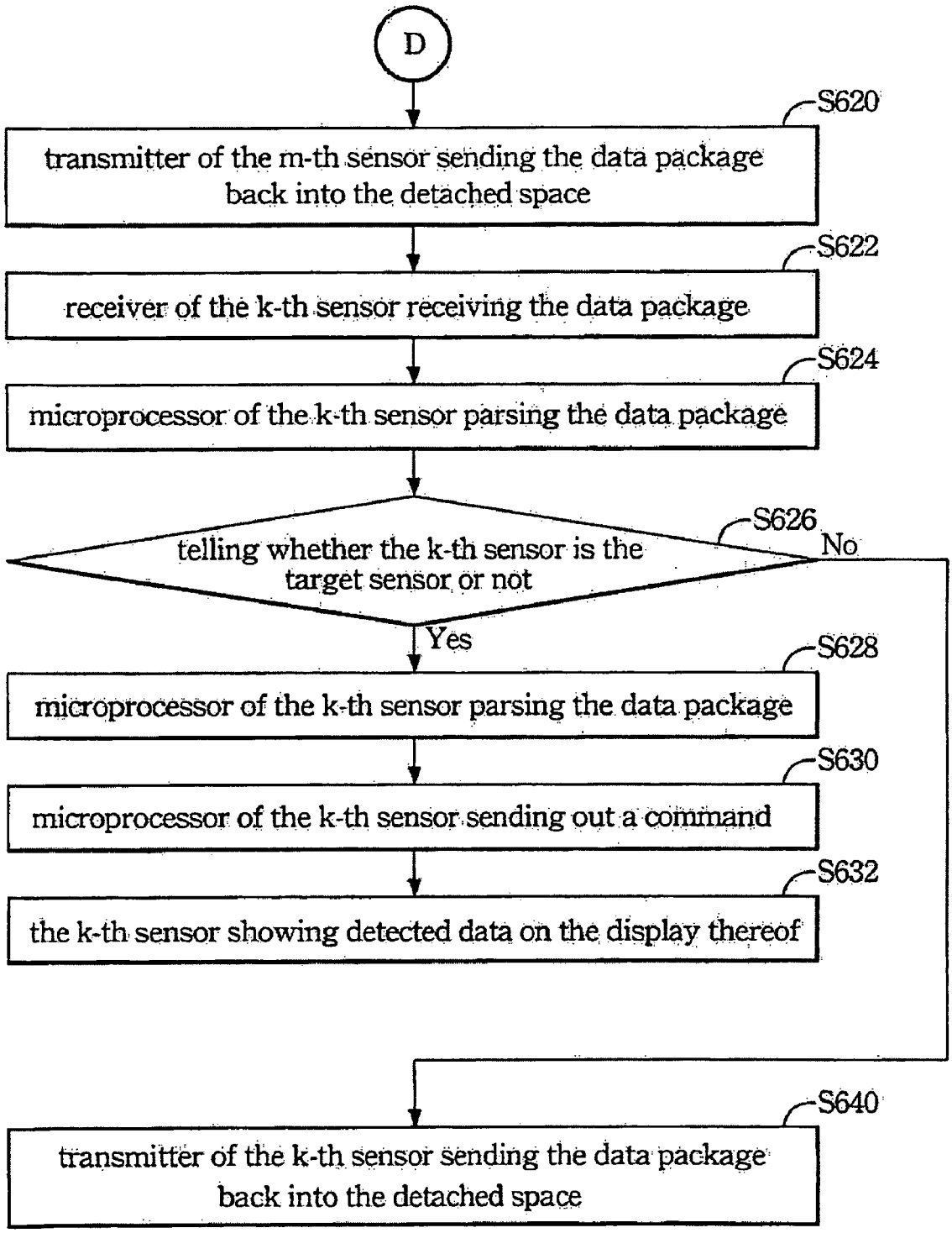

FIGS. 6-1 and 6-2 shows a preferred embodiment of an operation method of the collaborative wireless micro-control system with a sensor to automatically receive data. That is, the sensor may detect the variation of the environmental parameters within the detached space and show the detected result on a display so as to inform the user to change the operation mode of the electronic apparatus.

The operation of the electronic apparatus may be changed according to the detected result automatically or manually. That is, the operation of the electronic apparatus may be changed by a user command or by the data detected by the sensor automatically. Detail descriptions of the present embodiment are provided below.

Firstly, in step S600, the user sets the collaborative wireless micro-control system and selects the automatic mode. The sensor (the N-th sensor) receives the command to change the setting of the selector thereof. Then, in step S602, the microprocessor of the sensor changes the interior setting to an automatic mode. Thereafter, in step S604, the microprocessor of the sensor receives the data detected by the sensing device. As the microprocessor parses the data and decides if the operation of some interior control units or sensors needs to be varied, the microprocessor gathers the received data to further send out a data package. Then, in step S606, the transmitter of the sensor broadcasts the data package in the detached space. All the control units within the transmission range of the transmitter of the sensor may receive the data package.

Afterward, in step S608, the receiver of the sensor (the m-th sensor) within the transmission range receives the data package. Afterward, in steps S610 and S612, the microprocessor of the sensor parses the data package and tells whether the present sensor is the target sensor or not.

If so, in step S614, the microprocessor of the sensor parses the data package. Then, in step S616, the microprocessor of the sensor sends out a command according to the data package so as to change the operation mode thereof. Then, in step S618, the sensor may show detected data on the display thereof.

If not, process D us started. Referring to FIG. 6-2, in step S620, the transmitter of the sensor sends the data package back into the detached space. It is noted that all the interior control units or sensors within the transmission range of the transmitter of the present sensor may receive the signal package. Thereby, the overall transmission range of the data package is enlarged. Then, in step S622, the receiver of another sensor (the k-th sensor) within the transmission range receives the data package. Afterward, in steps S624 and S626, the microprocessor of the sensor parses the data package and tells whether the present sensor is the target sensor or not.

If so, in step S628, the microprocessor of the sensor parses the data package. Then, in step S630, the microprocessor of the sensor sends out a command according to the data package so as to change the operation mode thereof. Then, in step S632, the sensor may show detected data on the display thereof.

If not, in step S640, the transmitter of the sensor also sends the data package back into the detached space so as to enlarge the overall transmission range of the data package until the target sensor or interior control unit receives the data package.

Although the present invention and its advantages have been described in detail, as well as some variations over the disclosed embodiments, it should be understood that various other switches, substitutions and alterations can be made herein without departing from the spirit and scope of the invention as defined by the appended claims.

What is claimed is:

1. A collaborative wireless micro-control system, applied to a detached space, receiving an outside wireless signal from an electronic apparatus outside the detached space, comprising:

a main control unit, having a microprocessor, a transmitter, and a receiver, wherein the receiver receives the outside wireless signal from the electronic apparatus, wherein the microprocessor parses the outside wireless signal and sends out a wireless control signal inside the detached space by using the transmitter; and a plurality of interior control units for controlling respective electronic apparatuses, each of the interior control units having a microprocessor, a transmitter, and a receiver;

wherein the receiver of the interior control unit receives the wireless control signal from a main control unit of said interior control units, the microprocessor of the interior control unit is configured to determine whether or not the wireless control signal can trigger the respective electronic apparatus, the interior control unit adjusts the respective electronic apparatus according to the wireless control signal if so and the transmitter of the interior control unit passes-passing the wireless control signal to another interior control unit if not.

2. The collaborative wireless micro-control system of claim 1, further comprising a plurality of remote controls for sending commands to the respective interior control units so as to control the respective electronic apparatuses.

3. The collaborative wireless micro-control system of claim 2, wherein at least one of said remote controls is utilized for sending commands to the respective interior control unit directly or though another one of the interior control units.

4. The collaborative wireless micro-control system of claim 1, further comprising a plurality of outlets and each of the outlets including a transmitter and a receiver for passing the wireless control signal.

5. The collaborative wireless micro-control system of claim 1, ttrther comprising a plurality of sensors and each of the sensors having a sensing device, a microprocessor, a transmitter, and a receiver, wherein the sensing device outputs sensing data to the microprocessor, wherein the microprocessor parses the sensing data and sends out a command by the transmitter for controlling the corresponding electronic apparatus.

6. The collaborative wireless micro-control system of claim 5, wherein each of the sensors further comprises a selector for deciding how the sensing device gathering the sensing data.

7. An operation method of a collaborative wireless micro-control system, applied to a detached space, comprising the steps of (a) providing a plurality of electronic apparatuses in the detached space;

(b) providing a plurality of interior control units for controlling the respective electronic apparatuses;

(c) providing a wireless signal outside the detached space for controlling a target electronic apparatus of the electronic apparatuses;

(d) providing a main control unit to receive the wireless signal, to parse the wireless signal and to send out a wireless control signal into the detached space;

(e) receiving the wireless control signal;

(f) parsing the wireless control signal to determine whether or not the electronic apparatus receiving the wireless control signal is the target electronic apparatus; and (g) if so, controlling the respective electronic apparatus according to the wireless control signal; and if not, sending the wireless control signal back into the detached space.

8. The operation method of the collaborative wireless micro-control system of claim 7, wherein at least one of the interior control units is located within a transmission range of the main control unit.

9. The operation method of the collaborative wireless micro-control system of claim 7, further including a step, after the step (g), of if the respective electronic apparatus is not the target electronic apparatus, returning to the step (e).

10. The operation method of the collaborative wireless micro-control system of claim 7, further, in front of the step (d), comprising a step of providing a remote control sending a wireless control signal with respect to a target electronic apparatus.

11. The operation method of the collaborative wireless micro-control system of claim 10, wherein, after the step (g), if the respective electronic apparatus is not the target electronic apparatus assigned by the wireless control signal provided by the remote control, the method returns to the step (e).

12. The operation method of the collaborative wireless micro-control system of claim 7, further comprising, in front of the step (d), a step of providing a sensor to detect a change of environment parameter and to further transform the change into a wireless control signal with respect to a target electronic apparatus.

13. The operation method of the collaborative wireless micro-control system of claim 12, wherein, after the step (g), if the respective electronic apparatus is not the target electronic apparatus assigned by the wireless control signal provided by the sensor, the method returns to the step (e).

14. A setting method of a collaborative wireless micro-control system, applied to a detached space, comprising the step of:

(a) providing a collaborative wireless micro-control system having at least a main control unit and an interior control unit;

(b) installing and starting another interior control unit;

(c) entering a setting selection process of the installed interior control unit;

(d) choosing an auto-setting selection of the setting selection process of the installed interior control unit;

(e) the installed interior control unit listening to a response from the collaborative wireless micro-control system;

(f) the collaborative wireless micro-control system sending out a connecting invitation to the installed interior control unit;

(g) the installed interior control unit accepting the connecting invitation;

(h) the installed interior control unit replying an echo to the collaborative wireless micro-control system;

(i) the installed interior control unit and the collaborative wireless micro-control system saving identifications of each other; and (j) the interior control unit broadcasting a newly entry signal to the collaborative wireless micro-control system.

15. The setting method of a collaborative wireless micro-control system of claim 14, after the step (e), further comprising the steps of:

the installed interior control unit waiting for a first predetermined time; and, if the installed interior control unit does not receive the response from the collaborative wireless micro-control system within the first predetermined time, finishing the auto-setting selection of the setting selection process of the installed interior control unit.

16. The setting method of a collaborative wireless micro-control system of claim 14, after the step (c), further comprising the step of entering a manual setting process of the installed interior control unit.

17. The setting method of a collaborative wireless micro-control system of claim 16, after the step (I), further comprising the steps of:

the installed interior control unit waiting for a second predetermined time; and, if the installed interior control unit does not receive the connecting invitation from the collaborative wireless micro-control system within the first predetermined time, finishing the manual setting process of the installed interior control unit.

* * * * *